United States Patent [19]

Sørensen

[11] Patent Number: 5,050,639

[45] Date of Patent: Sep. 24, 1991

[54] OVERFILL PROTECTING ARRANGEMENT FOR A LIQUID STORAGE TANK

[76] Inventor: Emil A. Sørensen, Schützenmatte 2 A, CH-6362 Stansstad, Switzerland

[21] Appl. No.: 563,708

[22] Filed: Aug. 7, 1990

[51] Int. Cl.[5] ..... B63B 25/08

[52] U.S. Cl. ..... 137/587; 137/583; 137/529; 251/82; 114/74 R

[58] Field of Search ..... 137/583, 587, 529; 251/65, 82; 114/74 R, 212; 141/325

[56] References Cited

U.S. PATENT DOCUMENTS

| | | | |
|---|---|---|---|
| 2,700,395 | 1/1955 | Young | 137/529 X |
| 2,904,081 | 9/1959 | Wolf et al. | 137/583 X |
| 3,060,962 | 10/1962 | Graves | 137/587 |
| 3,421,546 | 1/1969 | Jennings et al. | 137/529 X |
| 3,495,620 | 2/1970 | Raimondi et al. | 137/529 |
| 3,926,135 | 12/1975 | De Gregorio | 114/74 R |
| 3,999,571 | 12/1976 | Pedersen et al. | 114/212 X |
| 4,144,829 | 3/1979 | Conway | 114/74 R |
| 4,233,922 | 11/1980 | Conway | 114/74 R |
| 4,292,909 | 10/1981 | Conway | 114/74 R |
| 4,482,017 | 11/1984 | Morris | 137/587 X |

*Primary Examiner*—John Rivell

*Attorney, Agent, or Firm*—Watson, Cole, Grindle & Watson

[57] ABSTRACT

An overfill protecting arrangement for a liquid storage tank comprises in combination a venting valve and a spill valve. The arrangement is designed for a maximum permissible loading rate, and the venting valve is so dimensioned that at this loading rate the tank pressure will assume an equivalent value substantially lower than a safety limit value prescribed by the authorities. The spill valve is a quick-opening valve, preferably a magnetic value, which has an opening pressure distinctly higher than said equivalent value of the tank pressure and lower than said safety limit value. The drops of pressure caused by a flow of liquid at the loading rate into the venting valve system and out of the fully open spill valve are so co-ordinated that flow of gas out of the spill valve and flow of liquid out of the venting valve cannot occur at any circumstances.

6 Claims, 3 Drawing Sheets

OVERFILL PROTECTING ARRANGEMENT FOR A LIQUID STORAGE TANK

BACKGROUND OF THE INVENTION

This invention relates to an overfill protecting arrangement for a liquid storage tank.

A particularly important field of use of the invention is for oil tankers, and more particularly for oil barges, and in the following the invention will be described with reference to this field of use, though it is to be understood that the invention is equally applicable to other uses where similar problems exist.

For the economic utilization of oil cargo vessels it is essential that it should be possible to load their tank or tanks up to almost 100% of their volumetric capacity without incurring any risk of rupture, explosion or environmental calamities.

In vessels equipped with high level electronic control systems it is well known to provide a liquid level sensor in the tank serving to deliver a feed-back signal to the loading pump to reduce the loading rate when the liquid level is approaching the top level of the tank, and to interrupt loading entirely, when a predetermined filling degree, say 97%, has been reached.

However, a need also exists for an overfill protecting arrangement not depending on the presence of an electronic control system communicating with a loading pump at a loading station.

Overfill protecting systems have been proposed, which comprise a spill valve acting in conjunction with a venting valve of the tank. In systems of this type, when the liquid level reaches the top level of the tank, the spill valve is opened by the tank pressure, and overflow commences. As soon as this is observed by a person aboard the vessel in charge of surveying loading, he shall issue a command to the loading station operator to stop loading.

SUMMARY OF THE INVENTION

It is an object of the invention to provide an overflow protecting arrangement of the type just described which fulfills the strictest safety requirements both during loading and during voyage and which requires no attendance beyond a check lift of the venting valve and the spill valve before loading is commenced, and careful watching of the spill valve towards the end of the loading time, which can be pre-calculated with close approximation, thereby to keep the quantity of overflowing liquid at a minimum, which can conveniently be collected and disposed of.

With this object in view, the invention consists of the combinations of features, which are recited in the appended claims, and will now be explained in detail, by way of a non-limitative example, with reference to the accompanying drawings.

DESCRIPTION OF THE PREFERRED EMBODIMENT

Figure 1:
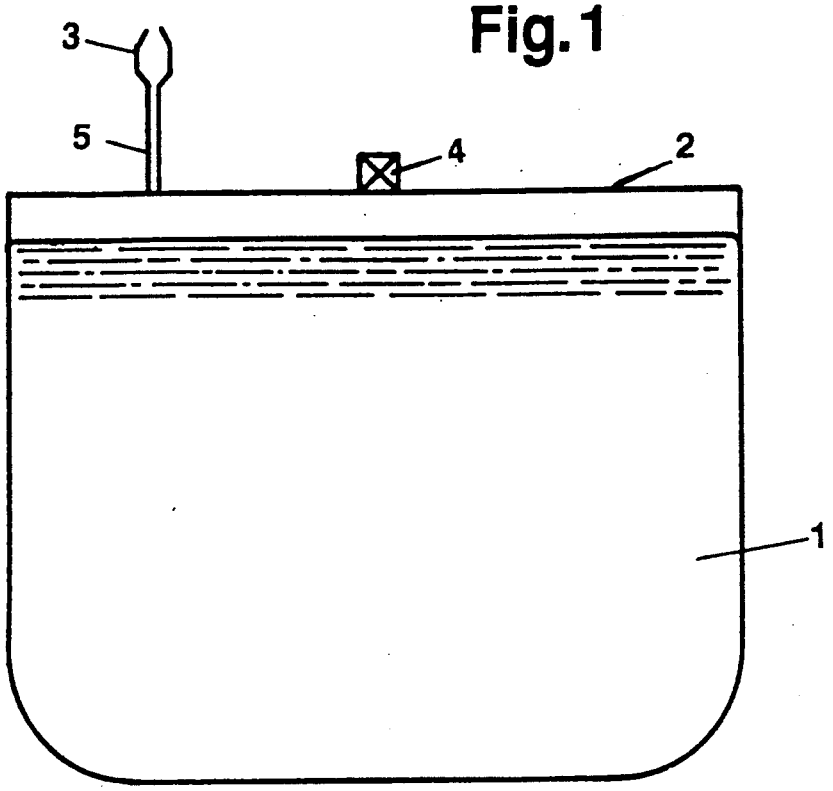
FIG. 1 is a diagrammatical sectional view of a tank provided with a venting valve and a spill valve constituting an arrangement according to the invention.

In FIG. 1, 1 is a liquid tank, such as the storage tank of an oil barge. On the top wall or deck 2 of the tank a venting valve 3 and a spill valve 4 are mounted. The venting valve 3 is located at a distance above the deck at the top end of a stand-pipe 5 connecting it with the interior of the tank. The spill valve 4 is mounted directly on the deck 2.

The venting valve 3 may be of any suitable construction fulfilling recognized safety requirements. It may e.g. be a high velocity valve of the type disclosed in U.S. Pat. No. 3,999,571 or International Application No. PCT/DK90/00050. The function of the venting valve is to permit the escape of gas from the interior of the tank in a controlled manner when the tank is being loaded or when the tank pressure rises owing to temperature variations. When loading is performed at a constant rate, as expressed in volumetric quantity per time unit, the venting valve will be opened when the tank pressure reaches a pre-set opening pressure value and thereafter should be capable of admitting the escape of the same volumetric quantity of gas per time unit with the addition of a percentage corresponding to the quantity of gas developed by evaporation from the surface of the liquid within the tank. For non-volatile liquids this percentage may be zero, while it is customary to fix this percentage at 25% for volatile oil products. By the flow of gas—including any addition for evaporation—out of the venting valve a pressure drop will be produced in the venting valve system comprising the venting valve and the stand-pipe, and the tank pressure—meaning here and in the following the pressure value above that of the atmosphere—will assume a value equal to that pressure drop. A venting valve must be so designed that at a prescribed maximum loading rate said pressure drop, and thereby the tank pressure, does not exceed a safety limit value prescribed by the competent authorities. At present it is customary to fix the safety limit value at 2 psi for oil barges, and at 3 psi for ocean-going oil tankers.

Regulations may also prescribe a minimum value of the opening pressure of the venting valve in order to have a driving pressure available for re-cycling the escaped vapor-containing gas during loading, where facilities for such re-cycling are available.

The venting valve may in well known manner be combined with a vacuum valve, or a separate vacuum valve may be provided, and/or a system may be provided for maintaining an inert gas atmosphere in the tank.

Figure 2:
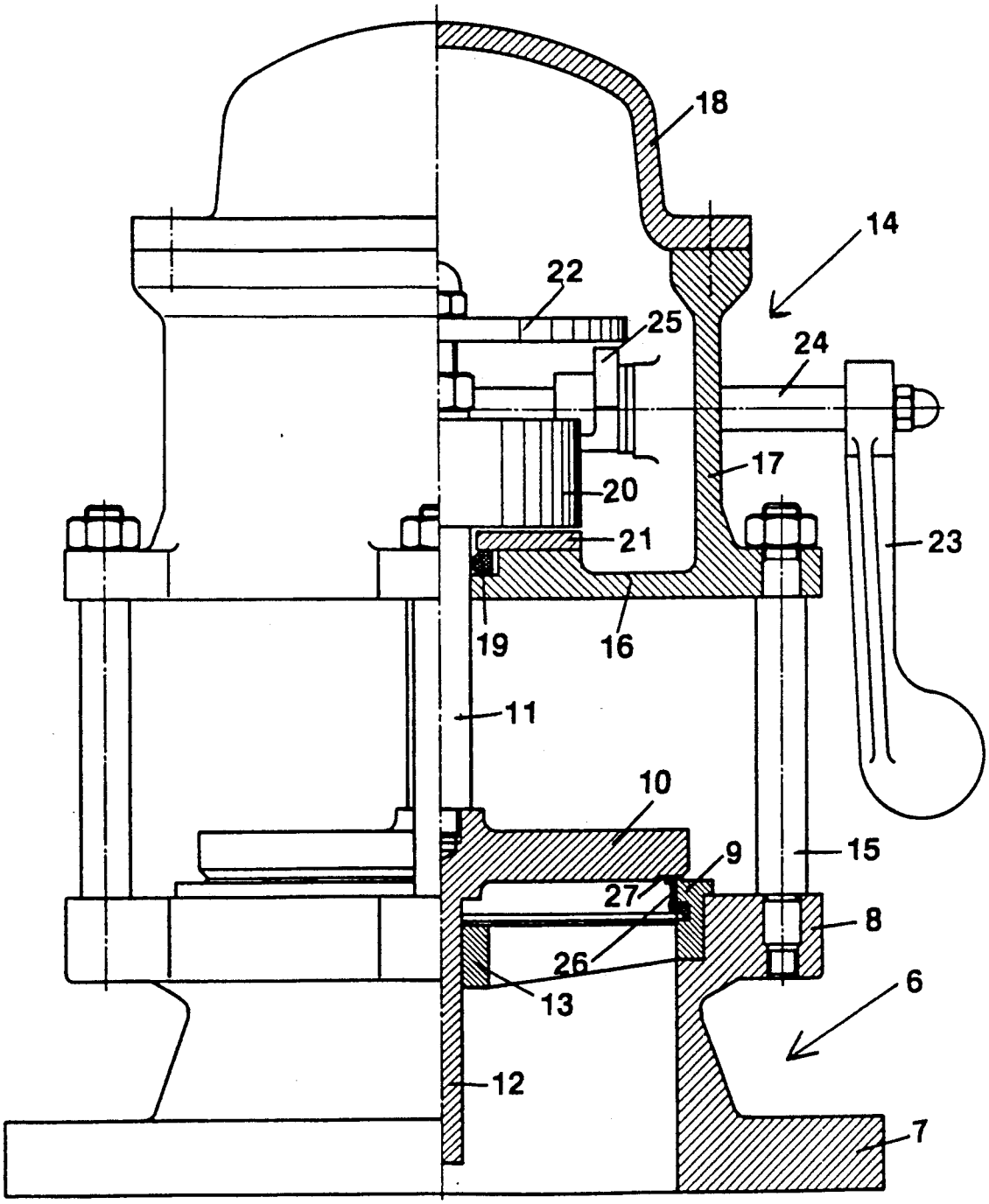
FIG. 2 is a side view, partly in section, of a spill valve that may be used in an arrangement according to the invention.

The spill valve illustrated in FIG. 2 has a base structure 6 constructed with a lower flange 7 and an upper flange 8. The lower flange 7 is adapted to be bolted or welded to the deck 2 around an opening therein. The upper flange 8 carries a horizontally disposed valve seat 9 co-operating with a disc-shaped valve body 10, which is attached to a stem 11 and carries a downwardly extending stem extension 12 which is guided in a hub 13 carried by the valve seat 9.

A housing 14 is supported at a distance above the valve seat 9 by means of stay bolts 15 rigidly secured to the upper flange 8 of the base structure 6. The housing 14 has a bottom 16, a circumferential wall 17 and a top cover 18. The stem 11 extends through and is guided in a hole in the bottom 16 in which a sealing ring 19 is provided. Within the housing 14 the stem 11 carries a permanent magnet 20 co-operating with an armature 21 fixedly mounted on the bottom 16 of the housing. Attached to the stem 11 is also a lifting disc 22 for co-operating with a check-lift arrangement 23, 24, 25 of a well known kind.

The magnet 20 and the valve body 10 are so axially adjusted relatively to one another that in the closing position of the valve body 10, where this engages the valve seat 9, the air gap between the magnet 20 and the armature 21 is almost closed. Thus, in its closing position the valve body is subjected to a high closing pressure resulting from the magnetic attraction between the magnet 20 and the armature 21. A further contribution to the closing pressure is delivered by the force of gravity acting on the valve body 10, the stem 11, the magnet 20 and the lifting disc 22. The arrangement is such that the closing pressure resulting from the magnetic attraction exceeds that resulting from gravity and preferably is at least twice as high, and more preferably even higher, e.g. in the range of three times as high.

Figure 3:
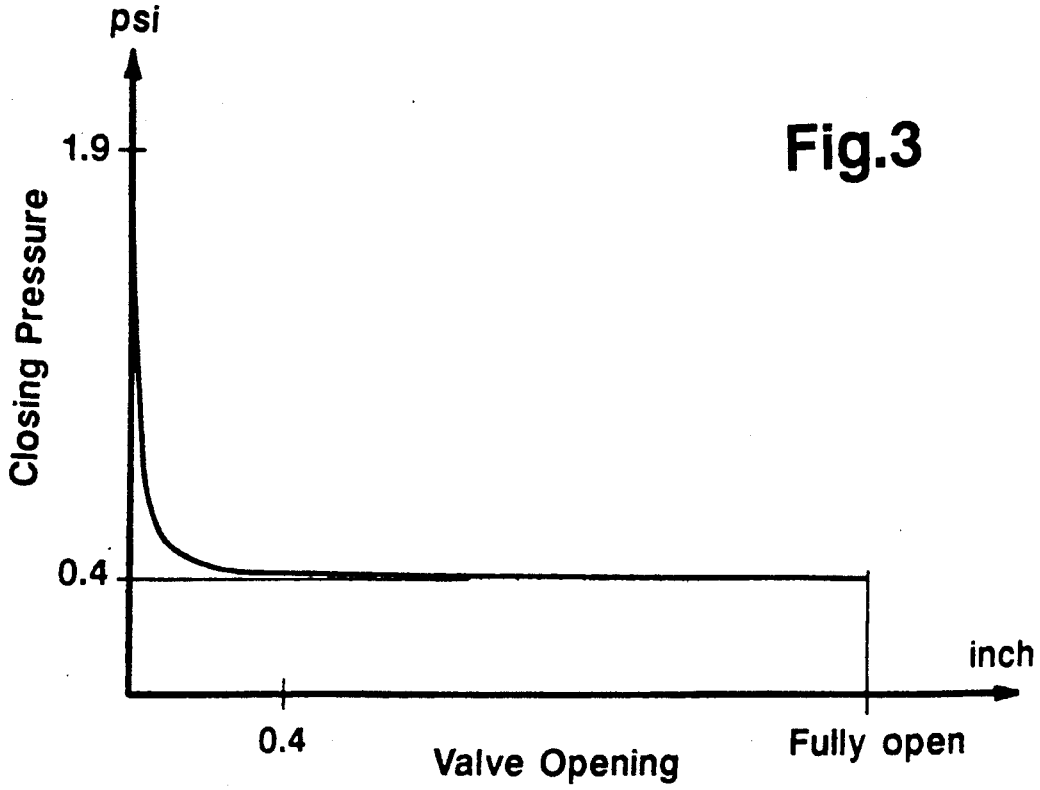
FIG. 3 is a graph illustrating by way of example the closing pressure acting on the valve body of a spill valve as in FIG. 2 as plotted against the lifting height of the valve body.

When the valve body 10 is lifted from its seat 9 in an overfill situation, as will be described later, the magnetic attraction force will immediately decrease drastically, while the force of gravity remains constant. Consequently, the total closing pressure acting on the valve body will depend on the lifting height in the manner illustrated in FIG. 3, which shows that upon opening of the valve the closing pressure almost instantaneously drops to a fraction of its value in the closing position. Conversely, when the valve is closed under the influence of the force of gravity, the closing pressure reassumes the high value resulting from the magnetic attraction force.

Figure 4:
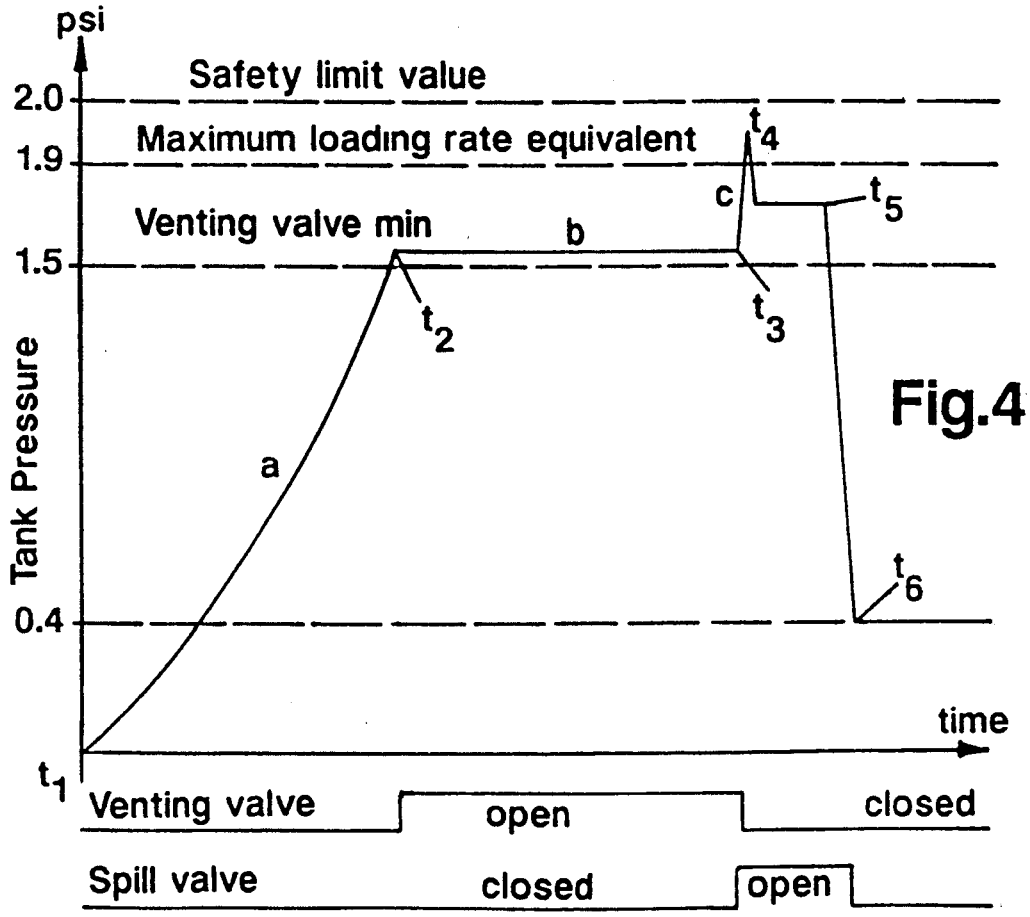
FIG. 4 is a graph illustrating the tank pressure as plotted against time in a sequence where a tank is loaded at a prescribed loading rate from empty beyond the overfill point, the figure also illustrating the opening and closing times of the venting valve and the spill valve.

The manner of co-operation of the venting valve 3 and the spill valve 4 to provide overfill protection, and the conditions to be fulfilled in order to preserve maximum safety both during loading and during voyage will now be described with reference to the example illustrated by the graphs in FIGS. 4 and 5.

In these figures, the line marked "Safety limit value" represents the above mentioned safety limit value of the tank pressure which may in no circumstances be exceeded. This may e.g. be 2.0 psi, as illustrated, for an oil barge.

The dimensioning of the venting valve to be used in the overfill protecting arrangement according to the invention depends on the maximum permissible loading rate prescribed for the barge or other tank structure, for which the arrangement is to be used. The dimensioning should be such that at that loading rate the pressure drop produced by a flow of gas through the stand pipe and the venting valve at the same volumetric rate, with the addition of an evaporation percentage, where applicable, is substantially lower than the safety limit value. The said pressure drop will be referred to in the following as the maximum loading rate equivalent. In the example illustrated, this is selected to be 1.8 psi.

It is a characteristic of the invention that the opening pressure of the spill valve is located in the pressure interval between the maximum loading rate equivalent and the safety limit value. This interval must therefore be large enough to ensure that the opening pressure of the spill valve can be made clearly distinct from the maximum loading rate equivalent so that the spill valve cannot be opened owing to an accidental momentary increase of the loading rate beyond the maximum permissible value.

Further considerations regarding the co-ordination of the operations of the venting valve and the spill valve will be apparent from the following description of a loading sequence starting at empty tank and continued at a constant rate beyond the overflow point.

Loading is started at point $t_1$, and since both the venting valve and the spill valve are closed the gas with which the tank was filled before loading was initiated is compressed so that the tank pressure rises, as illustrated by the graph a. When the tank pressure reaches the opening pressure for which the venting valve has been pre-set, the venting valve is opened, at point $t_2$, and soon assumes a position in which the drop of pressure caused by a flow of gas corresponding to the loading rate is equal to the tank pressure so that the latter is maintained constant, as illustrated by the graph b, during the further rise of the liquid level in the tank. In the example illustrated it is assumed that the loading rate is somewhat lower than the maximum permissible value. If the loading rate were increased up to that value, the horizontal graph portion b would be lifted up to the level "maximum loading rate equivalent", but it would still be lower than the opening pressure of the spill valve, and the spill valve will therefore never be opened, as long as there is still gas present in the tank. This is essential because a spill valve could not possibly be constructed to fulfill the safety requirements of a gas escape valve.

When the tank is full, at point $t_3$, the liquid starts rising up into the stand pipe 3. Here the flow of liquid will encounter a flow resistance which is much higher than the flow resistance to the earlier gas flow, and the tank pressure therefore increases steeply, as illustrated by the graph portion c.

If the cross section of the stand pipe has been chosen just sufficient to admit a flow of gas corresponding to the maximum permissible loading rate from the top of the tank to the venting valve without an appreciable drop of pressure, the flow of liquid now entering the stand pipe will very soon produce a drop of pressure bringing the tank pressure up to the value of the opening pressure of the spill valve.

If the cross section of the stand pipe is larger, e.g. in order to obtain a self-supporting structure of great mechanical strength, the increase of the tank pressure will be less abrupt.

At any rate, however, the opening pressure of the spill valve should be lower than the maximum loading rate equivalent value plus the pressure drop caused by a flow of liquid at the maximum loading rate from the top level of the tank to the level of the valve opening of the venting valve. If this condition is fulfilled, certainty is obtained that in an overfill situation the spill valve will be opened before the liquid reaches the valve opening of the venting valve.

When the opening pressure of the spill valve is reached, its valve body will, as previously explained, almost instantaneously be lifted to a height, at which the resistance to the outflow of liquid is low.

If loading is not immediately stopped, overflow through the spill valve will continue for some time until action is taken to stop loading. During the period of continuation of the overflow, the tank pressure will be determined by the pressure drop produced in the spill valve by a flow of liquid corresponding, at its maximum, to the maximum permissible loading rate. If the spill valve is so dimensioned that this pressure drop is lower than the hydrostatic pressure of a column of liquid of a height corresponding to the difference of levels between the valve opening of the venting valve and that of the spill valve, certainty is obtained that even during a period of continuation of overflow, the liquid present in the stand pipe in that situation can never reach the level of the venting valve opening, so that overflow will take place only through the spill valve.

When loading is stopped at $t_5$, the tank pressure will rapidly drop, and when, at $t_6$, it has reached a value corresponding to the closing pressure contributed by the force of gravity acting on the valve body and associated parts of the spill valve, the spill valve is closed, and its closing pressure is multiplied by the magnetic attraction force.

Figure 5:
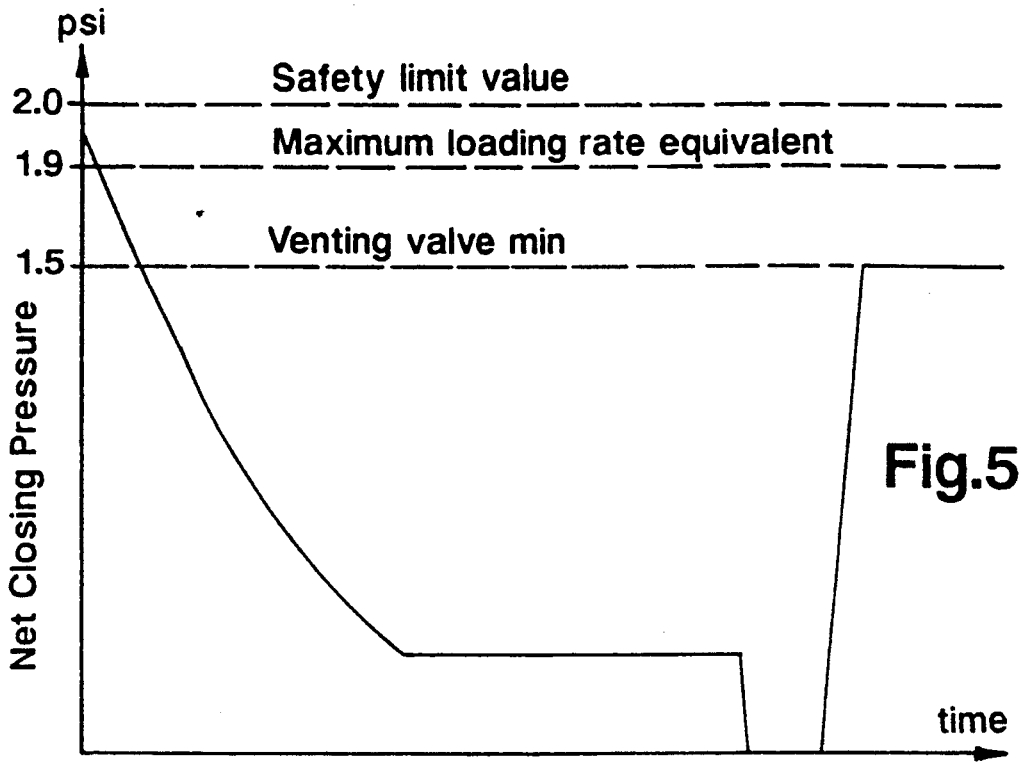
FIG. 5 is a graph illustrating the net closing pressure acting on the valve body of the spill valve as plotted against time in the same sequence as in FIG. 4.

FIG. 5 illustrates the variation of the net closing pressure acting on the valve body of the spill valve, as plotted against time. By the net closing pressure is to be understood the closing pressure resulting from magnetic attraction and gravity minus the tank pressure. It will be seen that, except in the period of actual overflow, the net closing pressure acting on the valve body of the spill valve will always have a substantial value, whereby the escape of gas through the spill valve is efficiently precluded. As an additional safety measure, the valve seat may be provided with a sealing ring 26 having a protruding lip 27 engageable with the valve body. Thereby tightness will be secured even in the case of some deterioration of the co-acting surfaces of the valve seat and the valve body.

In the case of a slow rise of the liquid level in the stand pipe 5, such as may e.g. occur if a tank of an oil cargo vessel has been fully loaded in the manner described and is subsequently during voyage exposed to a temperature variation, it is desirable that also in that situation the oil should be prevented from reaching the level of the venting valve so that any escape of surplus oil will take place through the spill valve. This can be obtained by adding a further condition for the selection of the opening pressure of the spill valve, viz. that it should be lower than the hydrostatic pressure of a column of liquid of a height corresponding to the difference of levels between the valve opening of the venting valve and that of the spill valve.

I claim:

1. An overfill protecting arrangement for a liquid storage tank, comprising in combination a venting valve (1) having a valve opening at an elevation above the top level of the tank and (2) having an opening pressure lower than a safety limit value and a closing pressure lower than said opening pressure, said venting valve (3) being so dimensioned that the pressure drop caused by a flow of gas corresponding to a loading rate prescribed as maximum permissible, as expressed in volumetric quantity per time unit, is substantially lower than said safety limit value, said pressure drop being referred to in the following as the maximum loading rate equivalent, and a spill valve (4) having a valve opening at a level lower than that of the valve opening of the venting valve and (5) having an opening pressure distinctly higher than said maximum loading rate equivalent, but lower than said safety limit value, (6) and also lower than said maximum value plus the pressure drop caused by a flow of liquid at said loading rate from the top level of the tank to the level of the valve opening of the venting valve, (7) and also lower than the hydrostatic pressure of a column of liquid of a height corresponding to the difference of levels between the valve opening of the venting valve and that of the spill valve, (8) and being constructed for quick opening to a position in which the pressure drop caused by a flow of liquid corresponding to said loading rate is lower than the hydrostatic pressure as defined in point (7).

2. An overfill protecting arrangement as in claim 1, in which the spill valve is a magnetic valve comprising at least one permanent magnet and an armature therefor connected with a stationary support and the valve body, respectively, or vice versa, and forming between them a magnetic airgap which in the closing position of the valve body is almost closed and provides a magnetic attraction force exceeding the force of gravity urging the valve body towards its seat.

3. An overfill protecting arrangement as in claim 2, in which said magnetic attraction force is at least twice as high as said force of gravity.

4. An overfill protecting arrangement as in claim 3, in which said magnetic attraction force is in the range of three times as high as said force of gravity.

5. An overfill protecting arrangement as in claim 2, in which said magnetic valve comprises a base structure carrying a horizontally disposed valve seat, a closed housing supported at a distance above said valve seat by spaced means permitting a substantially free efflux of liquid, a stem mounted for vertical sliding movement with respect to said valve seat and said housing, a valve body carried by said stem for co-operation with said valve seat, a permanent magnet carried by said stem within said housing, and an armature for said magnet fixedly mounted in said housing beneath said magnet.

6. An overfill protecting arrangement as in claim 2, in which the valve seat of said spill valve is provided with a sealing ring having an upwardly protruding lip for engagement with the valve body of said spill valve.

* * * * *